US010344350B2

(12) United States Patent
Lee

(10) Patent No.: US 10,344,350 B2
(45) Date of Patent: Jul. 9, 2019

(54) HIGH-STRENGTH STEEL SHEET WITH EXCELLENT COMBINATION OF STRENGTH AND DUCTILITY, AND METHOD OF MANUFACTURING THE SAME

(71) Applicant: KOREA INSTITUTE OF MACHINERY AND MATERIALS, Daejeon (KR)

(72) Inventor: Chang-Hoon Lee, Changwon-si (KR)

(73) Assignee: KOREA INSTITUTE OF MACHINERY AND MATERIALS, Daejeon (KR)

( * ) Notice: Subject to any disclaimer, the term of this patent is extended or adjusted under 35 U.S.C. 154(b) by 763 days.

(21) Appl. No.: 14/971,991

(22) Filed: Dec. 16, 2015

(65) Prior Publication Data

US 2016/0186286 A1 Jun. 30, 2016

(30) Foreign Application Priority Data

Dec. 30, 2014 (KR) ..... 10-2014-0193886
Dec. 30, 2014 (KR) ..... 10-2014-0193887

(51) Int. Cl.

| | |
|---|---|
| ***C21D 9/46*** | (2006.01) |
| ***C22C 38/06*** | (2006.01) |
| ***C22C 38/04*** | (2006.01) |
| ***C22C 38/02*** | (2006.01) |
| ***C21D 6/00*** | (2006.01) |

(52) U.S. Cl.

CPC ..... *C21D 9/46* (2013.01); *C21D 6/005* (2013.01); *C21D 6/008* (2013.01); *C22C 38/02* (2013.01); *C22C 38/04* (2013.01); *C22C 38/06* (2013.01)

(58) Field of Classification Search

CPC ..... C21D 9/46; C21D 6/00; C21D 6/005
USPC ..... 148/661
See application file for complete search history.

(56) References Cited

U.S. PATENT DOCUMENTS

2011/0162762 A1* 7/2011 Matsuda ..... C21D 1/20 148/533

FOREIGN PATENT DOCUMENTS

| | | |
|---|---|---|
| CN | 102149841 A | 8/2011 |
| CN | 102325916 A | 1/2012 |
| CN | 102337480 A | 2/2012 |

(Continued)

OTHER PUBLICATIONS

Notice of Allowance dated Oct. 12, 2016 from KIPO in connection with the counterpart Korean Patent Application No. 10-2014-0193886.

(Continued)

*Primary Examiner* — Weiping Zhu
(74) *Attorney, Agent, or Firm* — Hauptman Ham, LLP

(57) ABSTRACT

The present disclosure relates to a production of a high-strength steel sheet with excellent combination of strength and ductility, and a method of manufacturing the same. In accordance with a method of manufacturing a high-strength steel sheet, the method may include: heating a steel sheet which can have a residual austenite upon cooling, to form an austenite; primary cooling the austenitized steel sheet to T1 for a bainite region and subjecting to a primary isothermal transformation; and secondary cooling the primary isothermal transformed steel sheet to T2, which is lower than T1 by 50° C. ore more, for a bainite region, and subjecting to a secondary isothermal transformation.

14 Claims, 6 Drawing Sheets

(56) References Cited

FOREIGN PATENT DOCUMENTS

| | | | |
|---|---|---|---|
| JP | 2003328077 | A | 11/2003 |
| KR | 20110042369 | A | 4/2011 |
| KR | 1020110100868 | A | 9/2011 |
| KR | 101076092 | B1 | 10/2011 |
| KR | 1020120044151 | A | 5/2012 |
| KR | 10-2014-0130492 | A | 11/2014 |
| KR | 10-2015-0030465 | A | 3/2015 |

OTHER PUBLICATIONS

Chinese Office Action dated Apr. 3, 2018 in connection with the counterpart Chinese Patent Publication No. 201580072093.1.
Korean Office Action dated Jan. 25, 2016 in connection with the counterpart Korean Patent Application No. 10-2014-0193887.

* cited by examiner

HIGH-STRENGTH STEEL SHEET WITH EXCELLENT COMBINATION OF STRENGTH AND DUCTILITY, AND METHOD OF MANUFACTURING THE SAME

CROSS-REFERENCE TO RELATED APPLICATIONS

This application claims the benefit of Korean Patent Application NO. 10-2014-0193886, filed on Dec. 30, 2014, and Korean Patent Application NO. 10-2014-0193887, filed on Dec. 30, 2014, which are hereby incorporated by reference in their entirety into this application.

TECHNICAL FIELD

The present disclosure relates to a production of a high-strength steel sheet, and more particularly to a high-strength steel sheet with excellent combination of strength and ductility, and a method of manufacturing the same.

BACKGROUND ART

Transformation induced plasticity (TRIP) steel sheet is one that can achieve improved strength and ductility as a meta-stable austenitic structure remaining in the steel sheet is transformed by a plastic deformation applied from outside.

For a typical steel sheet, as the strength increases, the elongation is decreased, and vice versa. However, the TRIP steel sheet has good strength as well as good elongation.

The metastable austenitic structure necessary for the TRIP steel sheet is formed as follows: a steel sheet whose basic structure is formed of a ferrite and a pearlite with a suitable amount of Mn and Si is maintained at an appropriate temperature between Ac1 and Ac3 at which the ferrite and austenite structures coexist, allowing austenite stabilizing elements, particularly carbon, in the steel sheet to form a solid solution in the austenite. It is then quenched in bainite transformation region having a temperature lower than pearlite transformation region, then subjected to a transformation process at a constant temperature for several minutes, to form a pro-eutectoid ferrite in the austenite structure, which allows carbon to diffuse from the ferrite structure to the austenite structure and as a result carbon concentration is increased. In this way, the transformation starting temperature of the austenite to martensite, i.e., Ms point, can be lowered to below room temperature. Thus, even at the room temperature, the austenite may remain stable without being transformed to martensite. When the steel sheet containing this residual austenite undergoes a plastic deformation, the plastic deformation functions as a mechanical driving force for the residual austenite to transform to the martensite, and such martensite transformation makes a processing cure rate to increase, which in turn delaying necking, and as a result the ductility increases with the strength.

In the related prior art, Korean Laid-open Patent Publication No. 2011-0100868 (Publication Date: Sep. 15, 2011) discloses a high-strength cold-rolled steel with excellent tensile strength, yield strength and elongation, and a method of preparing the same.

DISCLOSURE

Technical Problem

One object of the present disclosure is to provide a method of manufacturing a high-strength steel sheet, capable of increasing a film-like residual austenite fraction using multistage isothermal transformation for bainite area.

Another object of the present disclosure is to provide a high-strength steel sheet with a high fraction of film-like residual austenite, and thereby to obtain an excellent combination of strength and ductility.

Technical Solution

In accordance with one aspect of the present disclosure, provided is a method of manufacturing a high-strength steel sheet, including: heating a steel sheet which can have a residual austenite upon cooling, to form an austenite; primary cooling the austenitized steel sheet to T1 for a bainite region and subjecting to a primary isothermal transformation; and secondary cooling the primary isothermal transformed steel sheet to T2, which is lower than T1 by 50° C. or more, for the bainite region, and subjecting to a secondary isothermal transformation.

In this embodiment, as the austenite is transformed to the bainite in the primary isothermal transformation, a film-like austenite and a block-like austenite are retained, while as the block-like austenite formed in the primary isothermal transformation is additionally transformed to the bainite in the secondary isothermal transformation, whereby the fraction of the film-like residual austenite can be increased.

In addition, the austenitization may be carried out at a temperature between Ac3 and Ac3+200° C. for at least one minute.

In addition, the primary cooling and the secondary cooling may be carried out with an average cooling rate of 20° C./sec or more, respectively.

In addition, the primary isothermal transformation may be carried out such that the bainite transformation has an area fraction of 30 to 70%.

In this embodiment, the steel sheet may include, on a weight percentage basis, C: 0.2 to 0.5%; Si: 1.0 to 3.0%; and Mn: 1.0 to 3.0%, the balance being Fe and inevitable impurities. In this embodiment, T1 is at least 400° C. or above, the primary isothermal transformation may be carried out for 20 to 100 seconds. In addition, the secondary isothermal transformation may be carried out for 100 seconds or more.

Further, the steel sheet may include, on a weight percentage basis, C: 0.2 to 0.5%; Si: 1.0% or less; Mn: 1.0 to 3.0%; and Al: 0.5 to 2.0%, the balance being Fe and inevitable impurities. In this embodiment, T1 is at least 400° C. or above, and the primary isothermal transformation may be carried out for 3 to 25 seconds. In addition, the secondary isothermal transformation may be carried out for 40 seconds or more.

In accordance with another aspect of the present disclosure, provided is a high strength steel sheet having a microstructure containing a bainite and a residual austenite, wherein the residual austenite has an area fraction of 10% or higher, and the residual austenite is formed of a film-like residual austenite having a length 3 times or more than a width and a block-like residual austenite having a length 3 times less than a width, wherein the film-like residual austenite has an area greater than the block-like residual austenite.

In this embodiment, the film-like residual austenite may have an area equal to or greater than 60% compared to the entire area of the residual austenite.

Further, the steel sheet may include, on a weight percentage basis, C: 0.2 to 0.5%; Si: 1.0 to 3.0%; and Mn: 1.0 to 3.0%, the balance being Fe and inevitable impurities.

Further, the steel sheet may include, on a weight percentage basis, C: 0.2 to 0.5%; Si: 1.0% or less; Mn: 1.0 to 3.0%; and Al: 0.5 to 2.0%, the balance being Fe and inevitable impurities.

Advantageous Effects

According to the high-strength steel sheet manufactured by the method according to the present disclosure, a large amount of film-like residual austenite can be formed through the two-stage isothermal heat treatment process to thereby produce a high-strength steel sheet with excellent combination of strength and ductility.

In addition, according to the method of manufacturing a high-strength steel sheet of the present disclosure, the time required for an isothermal heat treatment can be shortened by the addition of 0.5% by weight or more of Al, besides C, Si and Mn, whereby the productivity can be improved.

DESCRIPTION OF DRAWINGS

The above and other objects and features of the present invention will become apparent from the following description of the disclosure, when taken in conjunction with the accompanying drawings, in which.

BEST MODE

Figure 1:
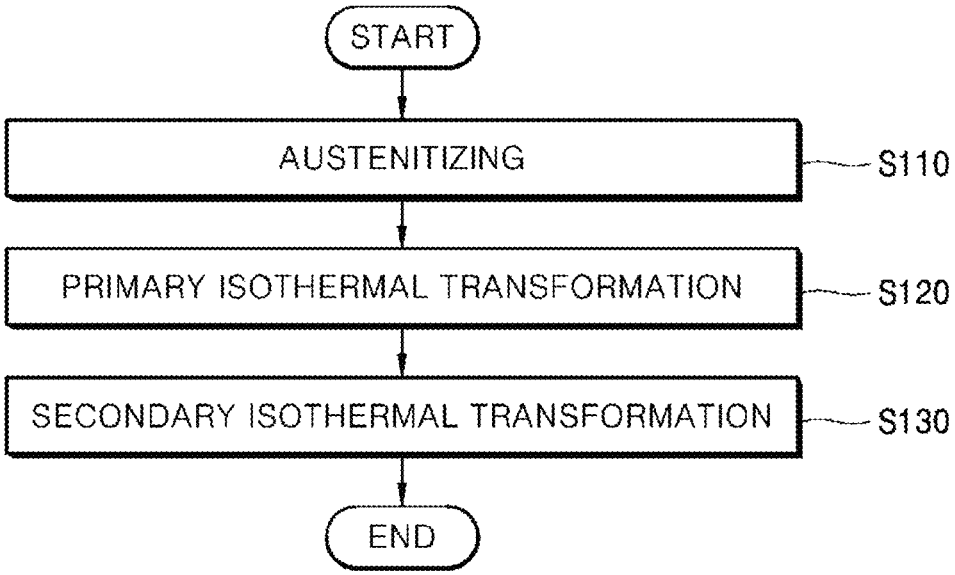
FIG. 1 is a flow chart illustrating a method of manufacturing a high-strength steel sheet according to the present disclosure.

Hereinafter, exemplary embodiments of the present disclosure will be described in detail with reference to the accompanying drawings.

A high-strength steel sheet according to the present disclosure has a microstructure containing a bainite and a residual austenite. The residual austenite has an area fraction of 10% or more. Further, the residual austenite is formed of a film-like residual austenite and a block-like residual austenite.

When a film-like residual austenite as used herein has a larger length than a width, it refers to a residual austenite having the length greater than or equal to three times the width, and, more specifically, it refers to a residual austenite having a maximum length greater than or equal to three times the maximum width. In addition, the block-like residual austenite refers to a residual austenite other than the film-like residual austenite, that is, the residual austenite having the length less than 3 times the width.

In this embodiment, the high-strength steel sheet according to the disclosure is characterized by that the film-like residual austenite has an area greater than the block-like residual austenite.

More specifically, the film-like residual austenite may have an area equal to or greater than 60% than the entire area of the residual austenite.

These features on the microstructure of the high-strength steel sheet according to the disclosure can be achieved by a production method including a multi-stage isothermal transformation in a bainite region, which will be described later.

The high-strength steel sheet according to the present disclosure may not be limited as long as the steel has an alloy composition that can include the residual austenite in a final microstructure, and more preferably a steel sheet having an alloy composition that can securely obtain an area fraction of the residual austenite to 10% or more. In addition, the steel sheet prior to a heat treatment may be a hot-rolled or cold-rolled steel sheet, and more preferably a cold-rolled steel sheet.

The high-strength steel sheet according to a first embodiment of the present disclosure may include, on a weight percentage basis, C: 0.2 to 0.5%; Si: 1.0 to 3.0%; and Mn: 1.0 to 3.0%, the balance being Fe and inevitable impurities.

Further, the high-strength steel sheet according to the first embodiment may further include, in place of Fe, at least one of P: 0.1% or less; S: 0.1% or less; Al: less than 0.5%; and N: 0.02% or less, on a weight percentage basis. Further, the high-strength steel sheet according to the embodiment may further include, in place of Fe, at least one of Cr: 3.0% or less; Mo: 1.0% or less; B: 0.005% or less; Nb: 0.1% or less; V: 0.5% or less; Ti: 0.1% or less; and Ca: 0.005% or less, on a weight percentage basis.

Carbon (C) is an element for forming a large amount of residual austenite in the steel sheet. The carbon is preferably included from 0.2 to 0.5% by weight with respect to the total weight of the steel sheet. When the carbon is contained less than 0.2% by weight, it may be difficult to ensure 10% or more of residual austenite in the final microstructure. On the contrary, when it exceeds 0.5% by weight, weldability may be deteriorated.

Silicon (Si) is an element that contributes to the enrichment of carbon in the residual austenite by suppressing the generation of carbide to thereby increase the thermal and mechanical stabilities of the austenite. The silicon functions as a deoxidizing agent in the steel. Further, the silicon contributes to the strength by stabilizing the ferrite. In addition, the silicon serves to increase the fraction of ferrite by promoting an austenite-ferrite transformation. In this embodiment, the silicon is preferably included from 1.0 to 3.0% by weight of the total weight of the steel sheet. When the silicon is contained in excess of 1.0% by weight, the addition effect is not sufficient. On the contrary, when it exceeds 3.0% by weight, weldability and coating property may be deteriorated.

Manganese (Mn) is an element that contributes to stabilize the austenite and to improve the strength. The Manganese is preferably added from 1.0 to 3.0% by weight of the total weight of the steel sheet. When the Manganese is contained less than 1.0% by weight, the addition effect is not sufficient. On the contrary, when the amount of Mn added exceeds 3.0% by weight, oxidation scale issues and plating problems may occur.

Meanwhile, the high-strength steel sheet according to the disclosure may further include phosphorus (P), sulfur (S), nitrogen (N), aluminum (Al), chromium (Cr), molybdenum (Mo), boron (B), niobium (Nb), vanadium (V), titanium (Ti), calcium (Ca), and the like, as impurities or for the purpose of improving the strength, etc. Some of phosphorous (P), sulfur (S), and nitrogen (N) may contribute to the strength, workability, grain refinement, etc., but large amounts thereof may cause, for example, toughness and cracking problems. Al may be added as a deoxidizing agent. When these elements are included, their contents may be limited as follows: P: 0.1% or less, S: 0.1% or less, Al: less than 0.5%, and N: 0.02% or less, on a weight percentage basis, with respect to the total weight of the steel sheet. Additionally, the elements, such as chromium (Cr), molybdenum (Mo), boron (B), niobium (Nb), vanadium (V), titanium (Ti) will contribute to the improvement of the strength of the steel, for example, through work hardening or precipitation hardening. Calcium (Ca) may contribute to the cleanness of the steel by spheroidizing of the inclusions. However, if this element is overdosed, the elongation will be decreased, and then the combination of strength and elongation will be rather deteriorated or super-saturated. Under the circumstances, the contents may be limited as follows: Cr: 3.0% or less, Mo: 1.0% or less, B: 0.005% or less, Nb: 0.1% or less, V: 0.5% or less, Ti: 0.1% or less, and Ca: 0.005% or less, on a weight percentage basis, with respect to the total weight of the steel sheet.

The high-strength steel sheet according to a second embodiment of the present disclosure may include C: 0.2 to 0.5%; Si: 1.0% or less; Mn: 1.0 to 3.0%; and Al: 0.5 to 2.0%, on a weight percentage basis. The balance may be formed of Fe and inevitable impurities.

Further, the high-strength steel sheet according to the second embodiment may further include, in place of Fe, at least one of P: 0.1% or less; S: 0.1% or less; and N: 0.02% or less, on a weight percentage basis. Further, the high-strength steel sheet according to the embodiment may further include, in place of Fe, at least one of Cr: 3.0% or less; Mo: 1.0% or less; B: 0.005% or less; Nb: 0.1% or less; V: 0.5% or less; Ti: 0.1% or less; and Ca: 0.005% or less, on a weight percentage basis.

The high-strength steel sheet according to the second embodiment may include no silicon, or, instead of 1.0% or less of Si, 0.5 to 2.0% of aluminum (Al), on a weight percentage basis.

In the high-strength steel sheet according to the second embodiment, the silicon is preferably contained 1.0% by weight or less relative to the total weight of the steel sheet. In this embodiment, it is contemplated that the aluminum (Al) is contained in a range of 0.5 to 2.0% by weight. Thus, when the content of silicon exceeds 1.0% by weight, weldability and coating property may be deteriorated.

Aluminum (Al) normally acts as a deoxidizing agent. However, in the high-strength steel sheet according to the second embodiment, Al functions to promote an austenite-bainite phase transformation, and thereby improve the productivity. The aluminum is preferably included from 0.5 to 2.0% by weight relative to the total weight of the steel sheet. If the amount of aluminum added is less than 0.5% by weight, the productivity-improving effects may be insufficient. On the contrary, if the amount of aluminum added exceeds 2.0% by weight, the surface quality of the steel sheet may be problematic.

Meanwhile, in the high-strength steel sheet according to the second embodiment, the silicon and aluminum that meet the requirements: $Si \leq Al$, and $Si+Al \leq 2.5\%$ by weight are more preferable in terms of the surface quality and plating property.

The high-strength steel sheet according to the disclosure may also further include phosphorus (P), sulfur (S), nitrogen (N), aluminum (Al), chromium (Cr), molybdenum (Mo), boron (B), niobium (Nb), vanadium (V), titanium (Ti), calcium (Ca), and the like, as impurities or for the purpose of improving the strength, etc. Some of phosphorous (P), sulfur (S), and nitrogen (N) may contribute to the strength, workability, grain refinement, etc., but large amounts thereof may cause, for example, toughness and cracking problems. When these elements are included, the contents may be limited as follows: P: 0.1% or less, S: 0.1% or less, and N: 0.02% or less, on a weight percentage basis, with respect to the total weight of the steel sheet. Additionally, the elements, such as chromium (Cr), molybdenum (Mo), boron (B), niobium (Nb), vanadium (V), titanium (Ti) will contribute to the improvement of the strength of the steel, for example, through work hardening or precipitation hardening. Calcium (Ca) may contribute to the cleanness of the steel by spheroidizing of the inclusions. However, if this element is overdosed, the elongation will be decreased, and then the combination of strength and elongation will be rather deteriorated or super-saturated. Under the circumstances, the contents may be limited as follows: Cr: 3.0% or less, Mo: 1.0% or less, B: 0.005% or less, Nb: 0.1% or less, V: 0.5% or less, Ti: 0.1% or less, and Ca: 0.005% or less, on a weight percentage basis, with respect to the total weight of the steel sheet.

In connection with the manufacturing method to be described later, the high-strength steel sheet having the alloy composition according to the first or second embodiment may have a tensile strength of 1,000 MPa or more, and the product of tensile strength and elongation of 25,000 MPa·% or more, and in some embodiments, 30,000 MPa·% or more. Further, the high-strength steel sheet according to the present disclosure can have an elongation of 25% or more.

Additionally, the high-strength steel sheet according to the present disclosure has a microstructure containing a bainite and a residual austenite. In this embodiment, the residual austenite has an area fraction of 10% or more. Further, the residual austenite is formed of a film-like residual austenite and a block-like residual austenite.

When the film-like residual austenite as used herein has a larger length than a width, it refers to the residual austenite having the length greater than or equal to three times the width, and, more specifically, it refers to the residual austenite having a maximum length greater than or equal to three times a maximum width. In addition, the block-like residual austenite refers to a residual austenite other than the film-like residual austenite, that is, the residual austenite having the length less than 3 times the width.

In this embodiment, the high-strength steel sheet according to the disclosure is characterized by that the film-like residual austenite has an area greater than the block-like residual austenite.

More specifically, the film-like residual austenite may have an area equal to or greater than 60% compared to the entire area of the residual austenite.

These features on the microstructure of the high-strength steel sheet according to the disclosure can be achieved by a production method including a multi-stage isothermal transformation in the bainite region, which will be described later.

FIG. 1 is a flow chart illustrating a method of manufacturing a high-strength steel sheet according to the present disclosure.

Referring to FIG. 1, methods of manufacturing the high-strength steel sheet according to some embodiments of the present disclosure can include an austenitizing step (S110), a primary isothermal transformation step (S120), and a secondary isothermal transformation step (S130).

The austenitizing step (S110) may include heating a steel sheet to form an austenite. Through this, the microstructure can be fully austenitized.

The steel sheet used herein may not be limited as long as the steel has an alloy composition that can include a residual austenite in a final microstructure, and more preferably a steel sheet having an alloy composition according to the first embodiment or the second embodiment that can securely obtain an area fraction of the residual austenite to 10% or more. In addition, the steel sheet prior to a heat treatment may be a hot-rolled or cold-rolled steel sheet, and more preferably a cold-rolled steel sheet.

The austenitization may be carried out at Ac3 to Ac3+200° C. for at least one minute, such as 1 minute to 30 minutes. If the austenitizing temperature is lower than Ac3, large amounts of ferrite remain, whereas if the austenitizing temperature exceeds Ac3+200° C., the grain size may be overly increased. In addition, if the austenitizing is carried out less than 1 minute, the austenitizing may be insufficient.

Next, the primary isothermal transformation step (S120) may include primary cooling the austenitized steel sheet to T1 for a bainite region, and then subjecting to a primary isothermal transformation. In this embodiment, the bainite region refers to a temperature zone in a range of below Bs, which refers to a bainite transformation initiating temperature, and over Ms, which refers to a martensite transformation initiating temperature.

In this embodiment, the primary isothermal transformation may be carried out at T1, but is not necessarily limited thereto, and may also be carried out at a temperature about 10° C. lower than T1 depending on process equipment conditions, etc. Similarly, this concept may also be applied in the secondary isothermal transformation, which will be described later.

Figure 2:
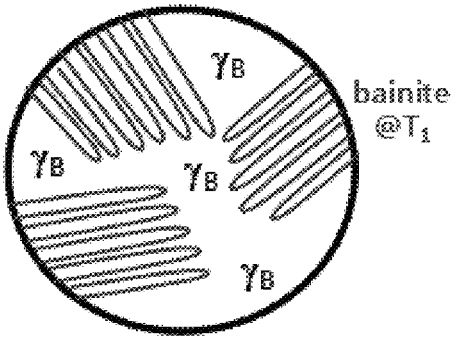
FIG. 2 is a schematic diagram showing that a bainite is formed from a primary isothermal transformation.

As a result of the primary isothermal transformation for bainite region, as in the example shown in FIG. 2, some of the austenite is transformed to the bainite, more specifically to a lath type bainite. A film-like austenite remains between the bainites, while a block-like austenite remains substantially in the region where the bainites are not formed.

The primary isothermal transformation may be carried out such that the bainite transformation is in the area fraction of 30 to 70%. It is contemplated that the film-like residual austenite is formed between the lath type bainites, and after the secondary isothermal transformation, the residual austenite is formed in an area fraction of greater than or equal to 10%.

The average cooling rate in the primary cooling may be applied at 20° C./sec or more, and more preferably 50 to 100° C./sec in order to suppress the occurrence of a possible phase transformation including ferrite.

Next, in the secondary isothermal transformation step (S130), the primary isothermal transformed steel sheet is secondarily cooled at an average cooling rate of 20° C./sec or more, such as 20 to 100° C./sec, up to T2 lower than T1 by 50° C. or more, and subjected to a secondary isothermal transformation. After the secondary isothermal transformation, final cooling may be carried out by air cooling, water cooling, etc., and the final cooling may be performed down to room temperature.

Figure 3:
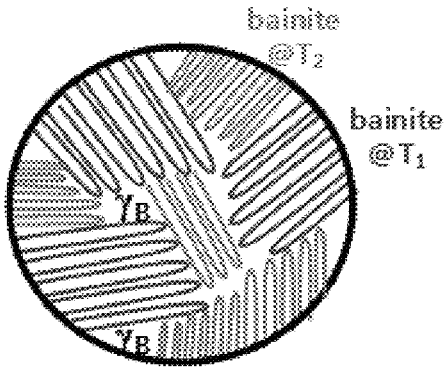
FIG. 3 is a schematic diagram showing that a bainite is additionally formed from a secondary isothermal transformation.

As a result of the secondary isothermal transformation for bainite region, as in the example shown in FIG. 3, some of the residual austenite is further transformed to the bainite. In this process, the bainite is formed from the block-like austenite, while the fraction of the film-like residual austenite increases.

Here, the secondary isothermal transformation temperature is at least 50° C. lower than the primary isothermal transformation temperature. This is why, as can be seen from the examples described later, if the difference between the secondary isothermal transformation temperature and the primary isothermal transformation temperature is less than 50° C., the strength is greatly reduced, which in turn results in a poor combination of the strength and the elongation.

That is, in the present disclosure, as the austenite is phase-transformed to the bainite in the primary isothermal transformation, the film-like austenite and the block-like austenite are retained, particularly as the block-like austenite formed in the primary isothermal transformation is additionally transformed to the bainite in the secondary isothermal transformation, whereby the fraction of the film-like residual austenite can be increased.

Meanwhile, for a steel sheet having an alloy composition according to the first embodiment, the primary isothermal transformation may be carried out at 400 to 600° C. for 20 to 100 seconds. In the steel sheet including the alloy composition, when T1 is less than 400° C., the secondary isothermal transformation which is above Ms may be difficult. In addition, when the time for the primary isothermal transformation is less than 20 seconds, the bainite may not be formed sufficiently, and when it exceeds 100 seconds, the residual austenite having the area fraction of 10% or more after the secondary isothermal transformation may be difficult to form.

Further, preferably, in the secondary isothermal transformation, the secondary isothermal transformation may be carried out over at least 100 seconds to form a sufficient bainite. In addition, the secondary isothermal transformation may be carried out at a temperature 50° C. lower than the primary isothermal transformation temperature. In addition, the secondary isothermal transformation may be carried out over at least 100 seconds, and more preferably 100 to 150 seconds. Through the secondary isothermal transformation over at least 100 seconds and a further transformation of a lath type bainite, the fraction of the film-like austenite in the residual austenite can be increased as much as possible.

On the other hand, for a steel sheet having an alloy composition according to the second embodiment, the primary isothermal transformation may be carried out at 400 to 600° C. for 3 to 25 seconds. In the present disclosure, when Al is added 0.5% by weight or more, the austenite-bainite phase transformation is promoted, and accordingly the phase transformation time can be reduced within 25 seconds. When the primary isothermal transformation time is less than 3 seconds, the bainite may not be sufficiently formed. On the contrary, when the primary isothermal transformation exceeds 25 seconds, the residual austenite having an area fraction of at least 10% after the secondary isothermal transformation may be difficult to form.

Further, preferably, in the secondary isothermal transformation, the secondary isothermal transformation may be carried out over at least 40 seconds, and more preferably 40 to 80 seconds to form a sufficient bainite. In the case of the alloy composition according to the first embodiment, approximately 100 seconds or more of the secondary isothermal transformation are required, while in the case of the alloy composition according to the second embodiment, the addition of Al can reduce the secondary isothermal transformation time to 40 seconds or more.

Examples

Hereinafter, the present disclosure will be explained in more detail with reference to illustrative preferred examples of the disclosure. It should be understood that these examples are provided for illustration only and are not to be in any way construed as limiting the present disclosure. A description of details apparent to those skilled in the art will be omitted for clarity.

1. Preparation of Sample Sheet

A cold-rolled steel sheet having alloy components listed in Table 1 was austenitized at 900° C. for 10 minutes, and then was primary cooled at the average cooling rate of 60° C./sec up to the primary isothermal transformation temperature listed in Table 2, and subjected to the primary isothermal transformation for 30 seconds. Subsequently, the resultant was secondary cooled at the average cooling rate of 25° C./sec up to the secondary isothermal transformation temperature listed in Table 2, and subjected to the second isothermal transformation for 100 seconds, and then finally cooled at the average cooling rate of 30° C./sec up to 25° C. to thereby prepare samples 1 to 8.

TABLE 1

| Grade | C | Si | Mn | Remarks |
|---|---|---|---|---|
| 1 | 0.18 | 1.5 | 2.1 | Comparative steel |
| 2 | 0.36 | 1.1 | 2.1 | Inventive sheet |
| 3 | 0.41 | 1.5 | 2.0 | Inventive sheet |
| 4 | 0.40 | 0.5 | 2.2 | Comparative steel |

TABLE 2

| Sample | Grade | Primary Isothermal transformation (° C.) | Secondary Isothermal transformation (° C.) | Remarks |
|---|---|---|---|---|
| 1 | 1 | 500 | 400 | Comparative sheet 1 |
| 2 | 2 | 500 | 400 | Inventive sheet 1 |
| 3 | 2 | 500 | 460 | Comparative sheet 2 |
| 4 | 3 | 400 | — | Comparative sheet 3 |
| 5 | 3 | 450 | 420 | Comparative sheet 4 |
| 6 | 3 | 450 | 400 | Inventive sheet 2 |
| 7 | 3 | 450 | 350 | Inventive sheet 3 |
| 8 | 4 | 450 | 400 | Comparative sheet 5 |

TABLE 3

| Grade | C | Si | Mn | Al | Remarks |
|---|---|---|---|---|---|
| 5 | 0.31 | 0.7 | 2.0 | 0.8 | Inventive sheet |
| 6 | 0.29 | — | 2.0 | 1.5 | Inventive sheet |

TABLE 4

| Sample | Grade | Primary Isothermal transformation (° C.) | Retention Time of Isothermal transformation | Secondary Isothermal transformation (° C.) | Remarks |
|---|---|---|---|---|---|
| 9 | 5 | 450 | 15 sec | 400 | Inventive sheet 4 |
| 10 | 6 | 450 | 10 sec | 400 | Inventive sheet 5 |

2. Microstructure and Properties Evaluation

For the prepared sample sheets 1 to 10, the fractions of the residual austenite were calculated through SEM image and TEM image analysis, wherein the austenite whose maximum length is at least three times the maximum width is classified as a residual austenite. Further, with respect to the prepared steel sheet samples, tensile tests were performed to determine the strength and elongation.

The results are shown in Table 5.

In Table 5, γ fraction indicates the fraction of the residual austenite, and f-γ fraction indicates the fraction of a film-like residual austenite within the residual austenite.

TABLE 5

| Sample | Grade | Tensile Strength (MPa) | Elongation (%) | Tensile strength * Elongation (MPa · %) | γ fraction (%) | f-γ fraction (%) | Remarks |
|---|---|---|---|---|---|---|---|
| 1 | 1 | 1007 | 18 | 18,126 | 9 | 72 | Comparative sheet 1 |
| 2 | 2 | 1012 | 29 | 29,348 | 12 | 68 | Inventive sheet 1 |
| 3 | 2 | 920 | 23 | 21,160 | 15 | 58 | Comparative sheet 2 |
| 4 | 3 | 1148 | 18 | 20,664 | 8 | 51 | Comparative sheet 3 |
| 5 | 3 | 985 | 28 | 27,580 | 12 | 53 | Comparative sheet 4 |
| 6 | 3 | 1051 | 31 | 32,581 | 15 | 73 | Inventive sheet 2 |
| 7 | 3 | 1064 | 28 | 29,792 | 14 | 78 | Inventive sheet 3 |
| 8 | 4 | 1018 | 23 | 23,414 | 7 | 67 | Comparative sheet 5 |
| 9 | 5 | 1012 | 31 | 31,372 | 15 | 65 | Inventive sheet 4 |
| 10 | 6 | 1037 | 29 | 30,073 | 13 | 67 | Inventive sheet 5 |

Further, a cold-rolled steel sheet having alloy components listed in Table 3 was austenitized at 900° C. for 10 minutes, and then was primary cooled at the average cooling rate of 60° C./sec up to the primary isothermal transformation temperature listed in Table 4, and subjected to the primary isothermal transformation at the same temperature. Subsequently, the resultant was secondary cooled at the average cooling rate of 25° C./sec up to the secondary isothermal transformation temperature listed in Table 2, and subjected to the second isothermal transformation for 60 seconds, and then finally cooled at the average cooling rate of 30° C./sec up to 25° C. to thereby prepare samples 9 and 10.

Referring to Table 5, for samples 2, 6, 7, 9 and 10 that meet the alloy composition, primary isothermal transformation, and secondary isothermal transformation conditions presented in this disclosure, they show a tensile strength of 1,000 MPa or more, a product of strength and elongation of 25,000 MPa·% or more, and an elongation of 25% or more.

However, when the sample(s) does not meet the alloy composition condition (samples 1 and 8), has not undergone the secondary isothermal transformation condition (sample 4), or the temperature difference during the two-stage isothermal transformation conditions is less than 50° C. (samples 3 and 5), tensile strength is less than 1,000 MPa, or the product of the strength and elongation is below 25,000 MPa·%.

Figure 4:
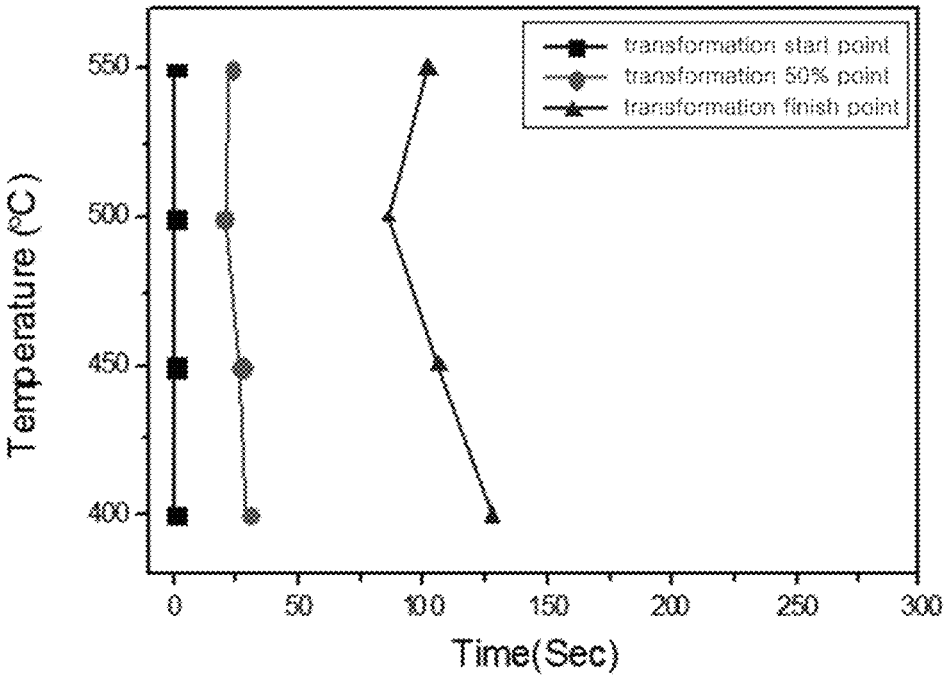
FIG. 4 is a diagram illustrating an isothermal transformation for grade 2.
Figure 5:
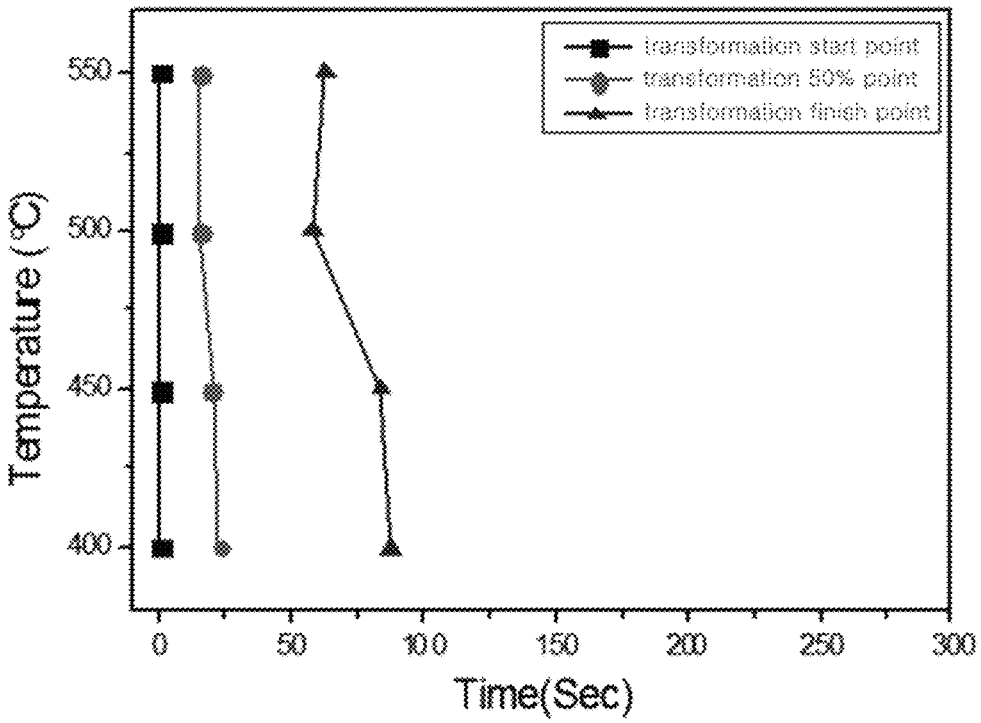
FIG. 5 is a diagram illustrating an isothermal transformation for grade 5.
Figure 6:
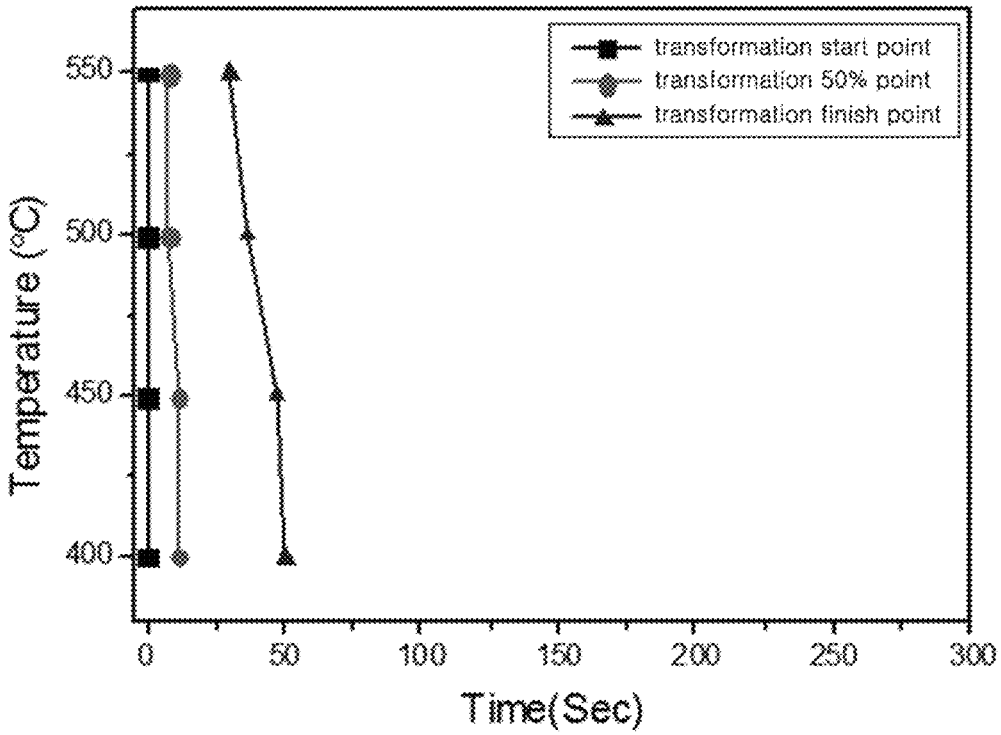
FIG. 6 is a diagram illustrating an isothermal transformation for grade 6.

FIG. 4 is a diagram illustrating an isothermal transformation for grade 2, FIG. 5 is a diagram illustrating an isothermal transformation for grade 5, and FIG. 6 is a diagram illustrating an isothermal transformation for grade 6. Referring to FIGS. 4 to 6, it can be seen that the transformation time for grades 5 and 6 containing Al 0.5% by weight is significantly reduced compared to the grade 2 without Al.

With these results, even though samples 9 and 10 has an isothermal transformation time relatively shorter than samples 2, 6 and 7, the prepared steel sheets can have at least equivalent physical properties, and thus can be found to be more desirable in terms of the productivity.

Although the present disclosure has been described with reference to the examples, it should be understood by those skilled in the art that these examples are given by way of illustration only, and that various modifications, variations, and alternations can be made without departing from the spirit and scope of the present disclosure. Accordingly, the scope of the present disclosure should be limited only by the accompanying claims and equivalents thereof.

INDUSTRIAL APPLICABILITY

The present disclosure provides a high-strength steel sheet with excellent combination of strength and ductility, and a method of manufacturing the same.

The invention claimed is:

1. A method of manufacturing a high-strength steel sheet, comprising:

heating a steel sheet which can have a residual austenite upon cooling, to form an austenite;

primary cooling the austenitized steel sheet to T1 for a bainite region, and then subjecting to a primary isothermal transformation; and secondary cooling the primary isothermal transformed steel sheet to T2 for a bainite region, and subjecting to a secondary isothermal transformation, wherein T2 is lower than T1 by 50° C. or more, and is 400° C. or more.

2. The method of claim 1, wherein as the austenite phase is phase transformed to a bainite in the primary isothermal transformation, a film-like austenite and a block-like austenite are retained, while as the block-like austenitic formed in the primary isothermal transformation is additionally transformed to the bainite in the secondary isothermal transformation, whereby the fraction of the film-like residual austenite is increased.

3. The method of claim 1, wherein the austenitization is carried out at a temperature of Ac3 to Ac3+200° C. for at least one minute.

4. The method of claim 1, wherein the primary cooling and the secondary cooling are carried out with an average cooling rate of at least 20° C./sec, respectively.

5. The method of claim 1, wherein the primary isothermal transformation is carried out such that the area fraction of the bainite transformation is in the range of between 30 and 70%.

6. The method of claim 1, wherein the steel sheet comprises C: 0.2 to 0.5%; Si: 1.0 to 3.0%; and Mn: 1.0 to 3.0%, the balance being Fe and inevitable impurities, on a weight percentage basis.

7. The method of claim 6, wherein the steel sheet further comprises at least one of P: 0.1% or less; Al: less than 0.5%; N: 0.02% or less; or at least one of Cr: 3.0% or less; Mo: 1.0% or less; B: 0.005% or less; Nb: 0.1% or less; V: 0.5% or less; Ti: 0.1% or less; and Ca: 0.005% or less, on a weight percentage basis.

8. The method of claim 6, wherein T1 is 400° C. or higher, and the primary isothermal transformation is carried out for 20 to 100 seconds.

9. The method of claim 6, wherein the secondary isothermal transformation is carried out for at least 100 seconds.

10. The method of claim 1, wherein the steel sheet comprises C: 0.2 to 0.5%; Si: 1.0% or less; Mn: 1.0 to 3.0%; and Al: 0.5 to 2.0%, the balance being Fe and inevitable impurities, on a weight percentage basis.

11. The method of claim 10, wherein the steel sheet meets the requirements: Si≤Al and Si+Al≤2.5% by weight.

12. The method of claim 10, wherein the steel sheet further comprises at least one of P: 0.1% or less; S: 0.1% or less; and N: 0.02% or less; or at least one of Cr: 3.0% or less; Mo: 1.0% or less; B: 0.005% or less; Nb: 0.1% or less; V: 0.5% or less; Ti: 0.1% or less; and Ca: 0.005% or less, on a weight percentage basis.

13. The method of claim 10, wherein Ti is 400° C. or higher, and the primary isothermal transformation is carried out for 3 to 25 seconds.

14. The method of claim 10, wherein the secondary isothermal transformation is carried out for at least 40 seconds.

* * * * *